US007438117B2

(12) United States Patent
Douro et al.

(10) Patent No.: US 7,438,117 B2
(45) Date of Patent: Oct. 21, 2008

(54) CYLINDER BLOCK CASTING BULKHEAD WINDOW FORMATION

(75) Inventors: John D. Douro, Ortonville, MI (US); Peter C. Emling, Oxford, MI (US); Jason M. Murphy, Auburn Hills, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 311 days.

(21) Appl. No.: 11/335,000

(22) Filed: Jan. 19, 2006

(65) Prior Publication Data

US 2007/0163744 A1 Jul. 19, 2007

(51) Int. Cl.
*B22D 33/04* (2006.01)
*B22C 9/10* (2006.01)

(52) U.S. Cl. ..... 164/137; 164/340; 164/369

(58) Field of Classification Search ..... 164/137, 164/369, 340, 355, 127
See application file for complete search history.

(56) References Cited

U.S. PATENT DOCUMENTS 7,013,948 B1 * 3/2006 Grebe et al. ..... 164/137
7,017,648 B2 * 3/2006 Newcomb et al. ..... 164/355

* cited by examiner

*Primary Examiner*—Kevin P Kerns

(57) ABSTRACT

A cylinder block casting is disclosed having a bulkhead window formed therein, the bulkhead window is formed by a set core received in one of a chill assembly and an integral barrel crankcase core of a mold package.

13 Claims, 7 Drawing Sheets

CYLINDER BLOCK CASTING BULKHEAD WINDOW FORMATION

FIELD OF THE INVENTION

The present invention relates to a cylinder block casting and more particularly to a cylinder block casting having a bulkhead window formed therein and a method of producing the same.

BACKGROUND OF THE INVENTION

In a sand casting process of an internal combustion engine cylinder block, an expendable mold package is assembled from a plurality of resin-bonded sand cores that define the internal and external surfaces of the engine block. Typically, each of the sand cores is formed by blowing resin-coated foundry sand into a core box and curing it therein.

Traditionally, the mold assembly method involves positioning a base core on a suitable surface and building up or stacking separate mold elements to shape such casting features as the sides, ends, valley, water jacket, cam openings, and crankcase. Additional cores may be present as well depending on the engine design.

Removal of thermal energy from the liquid metal in the mold package is an important consideration in the foundry process. Rapid solidification and cooling of the casting promotes a fine grain structure in the metal leading to desirable material properties such as high tensile and fatigue strength, and good machinability.

For engine designs with highly stressed bulkhead features, the use of a thermal chill may be necessary. The chill is much more thermally conductive than foundry sand and readily conducts heat from those casting features it contacts. The chill consists of one or more steel or cast iron bodies assembled in the mold in a manner to shape some portion of the features of the casting. A crankcase chill is typically placed into the base core tooling and a core formed about them, or they may be assembled into the base core or between the crankcase cores during mold assembly.

Windows are added to a bulkhead to improve breathing or airflow from bay to bay in the engine cylinder block, or to remove a very thin wall condition. In some cases, holes are drilled through the bulkheads to provide the bay to bay breathing. However, since the bulkhead is one of the most highly stressed portions of an engine cylinder block, extreme care must be used when designing and manufacturing the windows to avoid unintended stress concentrating anomalies.

It would be desirable to produce a cylinder block casting having a window formed in a bulkhead thereof, wherein the peak mechanical stresses present in the bulkhead are minimized and not unintentionally concentrated, and casting efficiency and casting accuracy are maximized.

SUMMARY OF THE INVENTION

Consistent and consonant with the present invention, a cylinder block casting having a window formed in a bulkhead thereof, wherein the peak mechanical stresses present in the bulkhead are minimized and not unintentionally concentrated, and casting efficiency and casting accuracy are maximized, has surprisingly been discovered.

In one embodiment, a vent window core comprises a main body adapted to be assembled with one of a crankcase chill and an integral barrel crankcase core of a mold package; and a shoulder extending laterally outwardly from a side of the main body, a cross-sectional shape of the shoulder determining a final shape of a vent window formed in a bulkhead of an engine cylinder block, and wherein the shoulder has a length which is substantially equal to a desired depth of the window and the vent window core tooling is designed to militate against a tooling seam or parting on the window-forming surface of the shoulder.

In another embodiment, a mold package for casting of an engine cylinder block comprises a crankcase chill; an integral barrel crankcase core adapted to be disposed on the crankcase chill; and a vent window core adapted to be disposed between the crankcase chill and the integral barrel crankcase core, the vent window core further comprising: a main body; and a shoulder extending laterally outwardly from a side of the main body, a cross-sectional shape of the shoulder determining a final shape of a window formed in a bulkhead of an engine cylinder block.

The invention also provides methods of producing a cylinder block casting.

In one embodiment, the method of producing a cylinder block casting comprises the steps of providing a mold package; providing a vent window core including a main body and a shoulder extending laterally outwardly from a side of the main body, a shape of the shoulder determining a final shape of a window formed in a bulkhead of the engine cylinder block; assembling the vent window core with the mold package; filling the mold package with molten metal; and removing the cylinder block casting from the mold package.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed and illustrated, the steps presented are exemplary in nature, and thus, the order of the steps is not necessary or critical.

Figure 1:
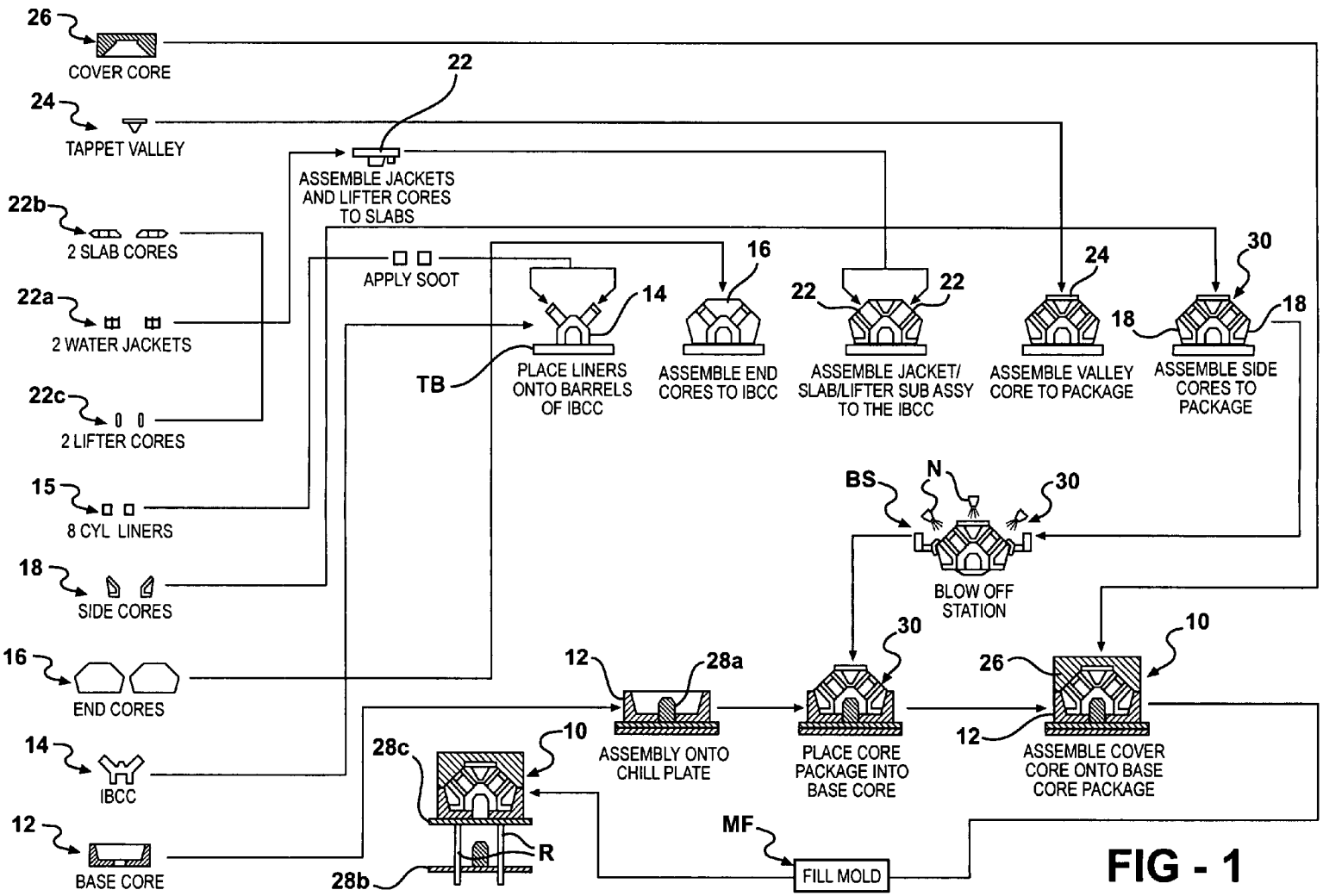
FIG. 1 is a flow diagram showing an assembly process for an engine V-block mold package with the front end core omitted for clarity.

FIG. 1 depicts a flow diagram showing a sequence for assembling an engine cylinder block mold package 10. The invention is not limited to the sequence of assembly steps shown as other sequences can be employed to assemble the mold package. For purposes of illustration, and not limitation, a core for an eight-cylinder V-type engine is shown. It is understood that more or fewer cylinders can be used and that other engine cylinder configurations can be used. It is also understood that the features of the invention could be used with other core types. In the embodiment shown, a resin bonded sand core is used.

The mold package 10 is assembled from resin-bonded sand cores including a base core 12 mated with a crankcase chill 28*a,* a chill plate 28*b,* and a mold carrier plate 28*c,* an integral barrel crankcase core (IBCC) 14, two end cores 16, two side cores 18, two water jacket slab core assemblies 22, a tappet valley core 24, and a cover core 26. The IBCC 14 includes a plurality of metal cylinder bore liners 15 disposed thereon. The water jacket slab core assembly 22 includes a water jacket core 22*a,* a jacket slab core 22*b,* and a lifter core 22*c.* The cores 12, 14, 16, 18, 22, 24, 26 described above are offered for purposes of illustration and not limitation as other types of cores and core configurations may be used in assembly of the engine cylinder block mold package 10, depending upon the particular engine block type to be cast. For illustrative purposes, only a crankcase chill 28*a* has been shown in FIG. 1, however, it is understood that other chill types can be used as desired. The use of chills in a casting process such as that described herein facilitates forming of a desired grain structure in cast metal parts.

Figure 2:
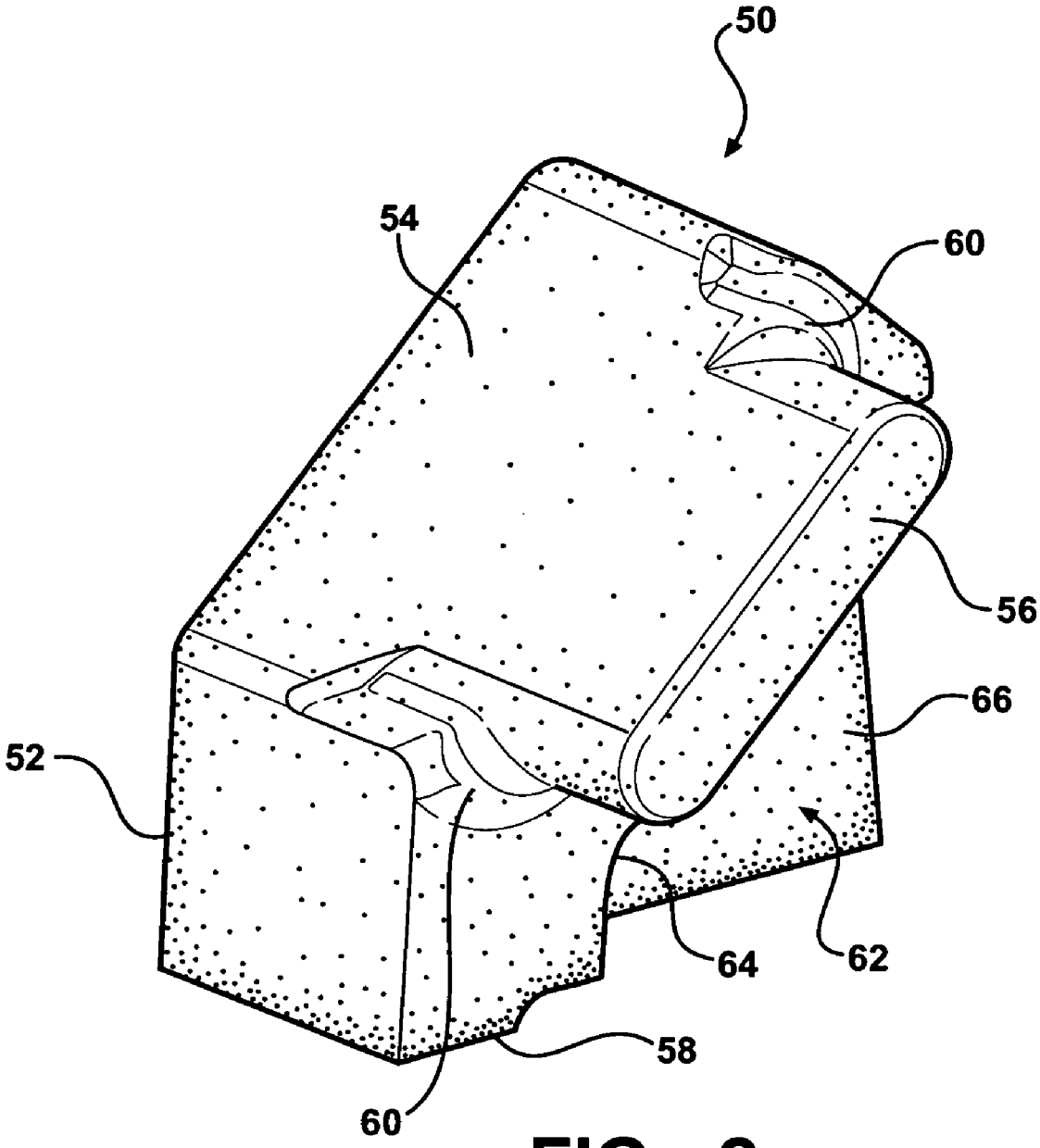
FIG. 2 is a perspective view of a set core for forming a vent window according to an embodiment of the invention.

In FIG. 2, a vent window core 50 is shown according to an embodiment of the invention. The vent window core 50 includes a main body 52 adapted to be assembled with the mold package 10. An upper surface 54 of the main body 52 is disposed at an angle with respect to horizontal. In the embodiment shown, the angle is approximately 45 degrees, although the upper surface 54 can be disposed at other angles as desired, or be substantially horizontal.

A shoulder 56 extends laterally outwardly from one side of the main body 52 and is spaced from a lower surface 58 of the main body 52. The shoulder 56 has an elongated substantially oval cross-sectional shape, although other shapes can be used as desired which are consistent with a desired final shape of the bulkhead window 44. A lateral length of the shoulder 56 is substantially equal to a depth or thickness of the bulkhead window 44, which is equal to a thickness of the bulkhead 46. A transition section 60 is disposed between the main body 52 and the shoulder 56. An outer surface of the transition section 60 is substantially rounded and cooperates with the shoulder 56 to form the bulkhead window 44 (illustrated in FIG. 7) and the adjacent bulkhead surface during the casting process. A recess 62 is formed under the shoulder 56 by a curved upper wall 64 and a substantially planar side wall 66. The recess 62 facilitates assembly of the vent window core 50 in the mold package 10 and proper positioning of the vent window core 50 within the mold package 10.

Figure 3:
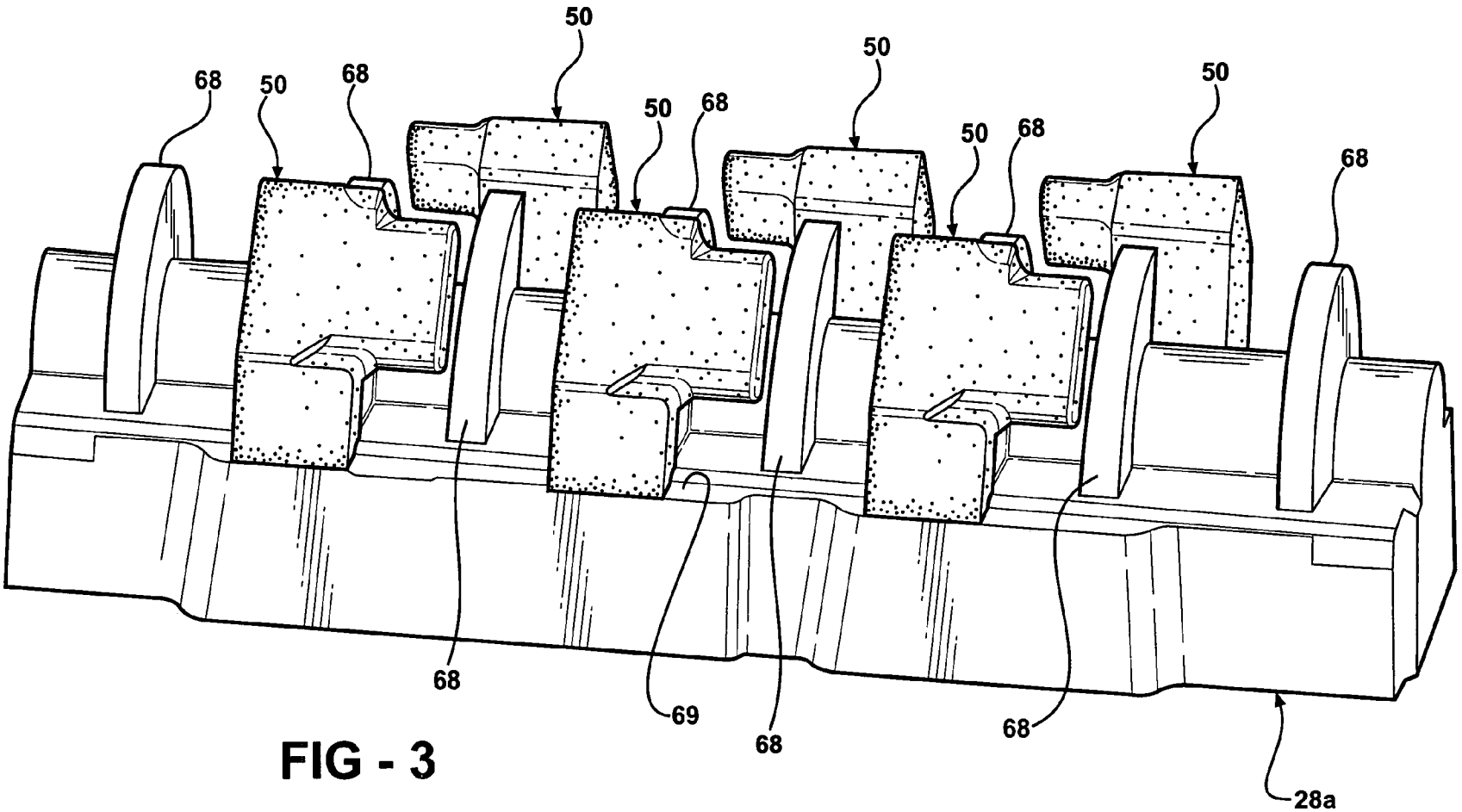
FIG. 3 is a perspective view of a chill assembly including a plurality of set cores disposed thereon.

A method of assembly of the vent window core 50 with the mold package 10 is depicted in FIGS. 3-6. A plurality of vent window cores 50 is disposed on the crankcase chill 28*a,* as shown in FIG. 3. In the embodiment shown, the upper wall 64 forming the recess 62 in the vent window core 50 is seated on one of a plurality of semicircular extensions 68 extending laterally upwardly from an upper surface of the crankcase chill 28*a.* Additionally, a ledge 69 supports a portion of the lower surface 58 of the main body 52.

Figure 4:
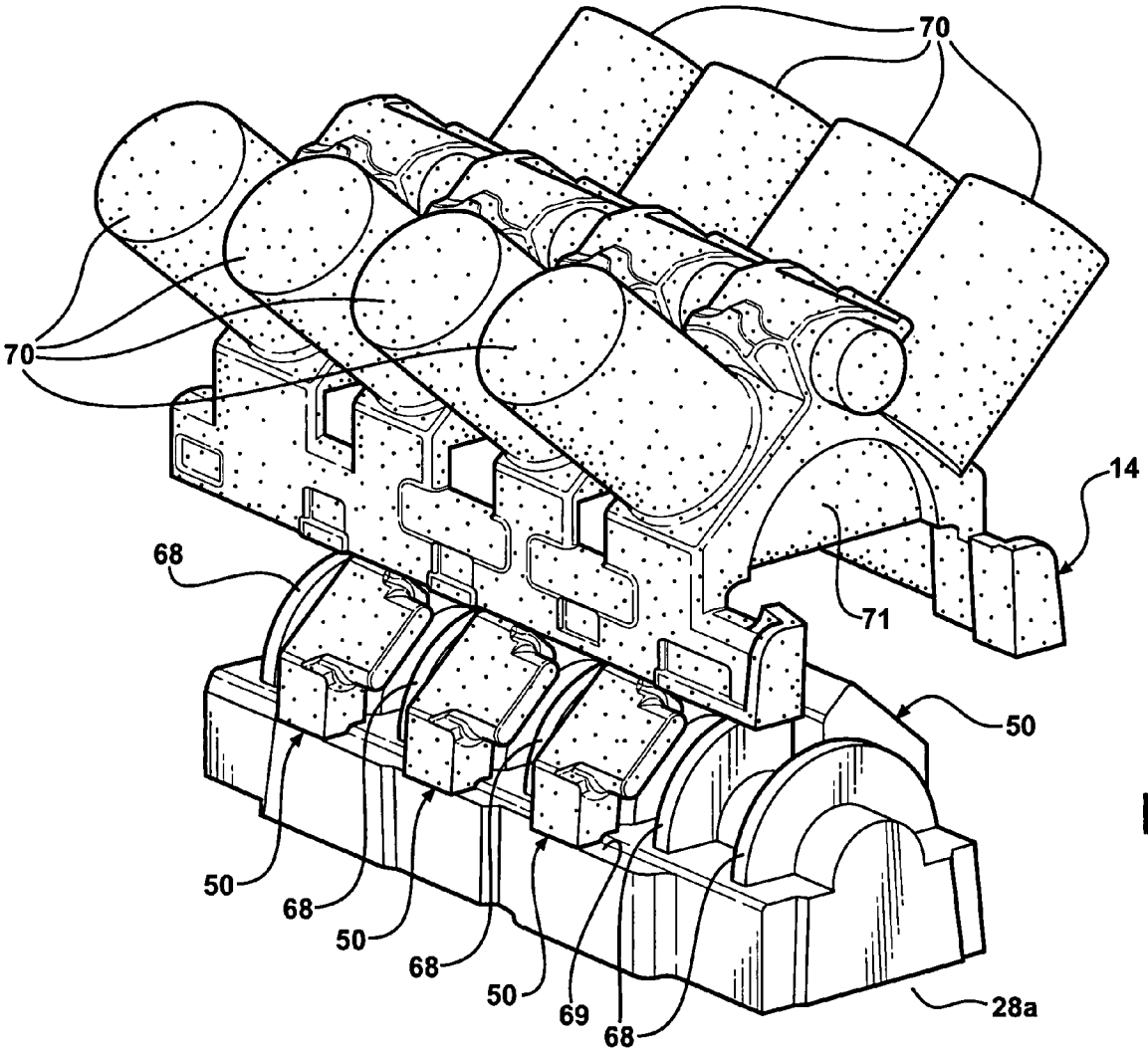
FIG. 4 is an exploded perspective view of the chill assembly of FIG. 3 and an integral barrel crankcase core.

As illustrated in FIG. 4, once the vent window cores 50 are assembled with the crankcase chill 28*a,* the IBCC 14 can be assembled with the crankcase chill 28*a.* In an eight cylinder V-type engine block, six vent window cores 50 are provided and positioned in spaces below the cylinder barrel features 70 and between crankcase features 71 to extend between adjacent crankcase features 71.

Figure 5:
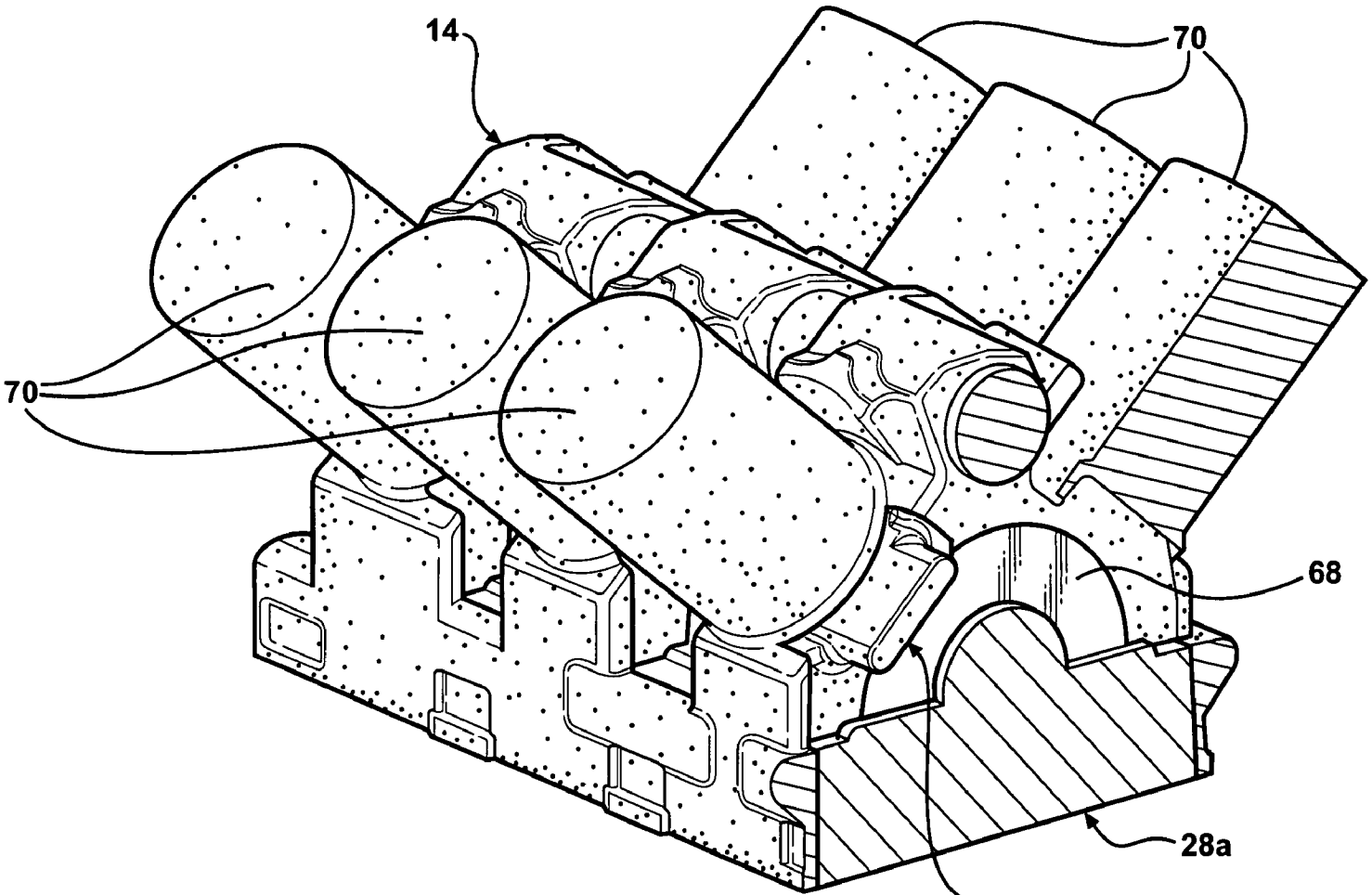
FIG. 5 is a perspective view partially in section of the chill assembly and the integral barrel crankcase core of FIG. 4 shown assembled.

FIG. 5 depicts the assembled IBCC 14, vent window cores 50, and crankcase chill 28*a.* An end of the assembly is illustrated in section to show the position of the vent window core 50 in respect of the cylinder barrel feature 70.

Figure 6:
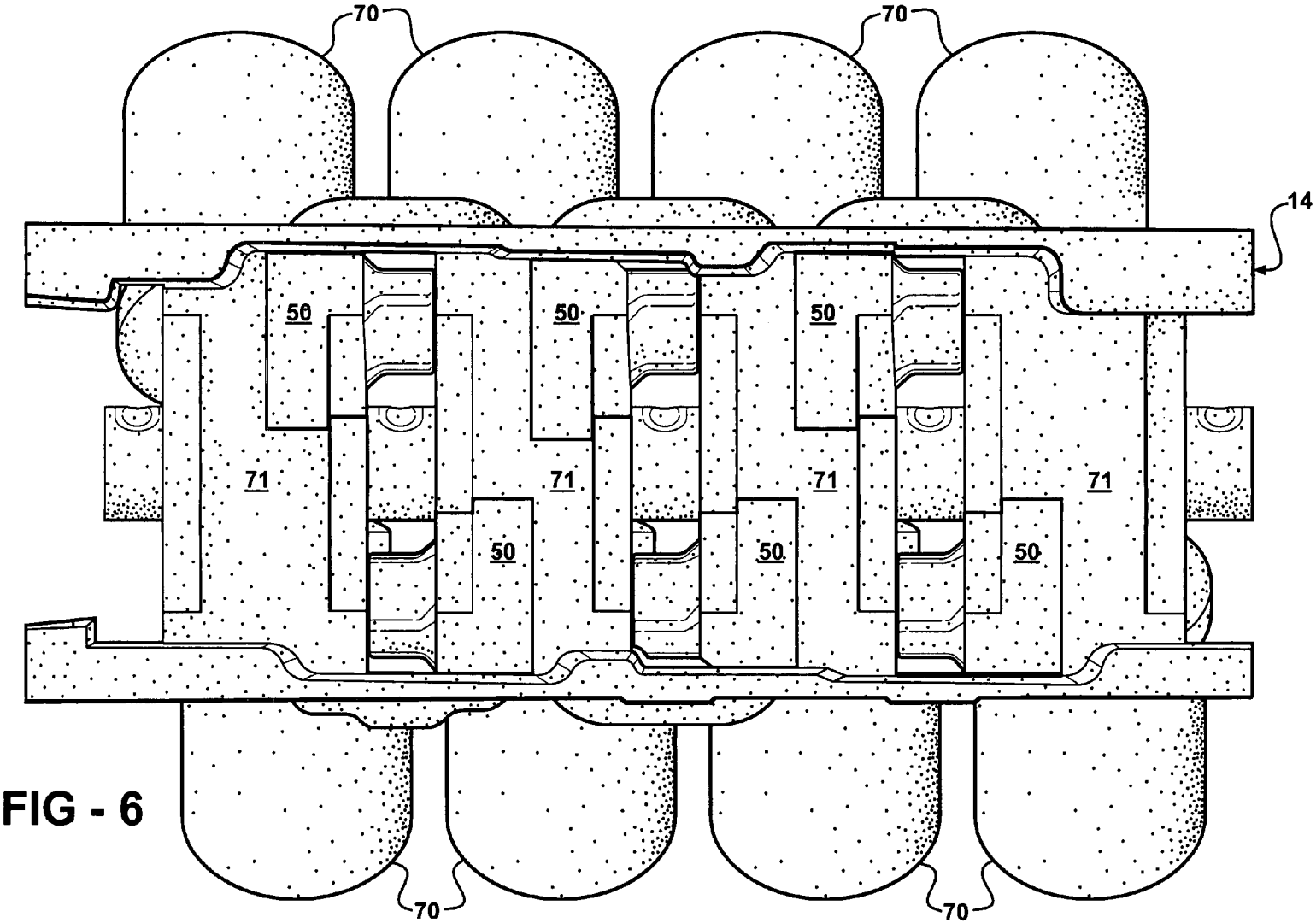
FIG. 6 is a bottom plan view of an integral barrel crankcase core including a plurality of set cores assembled therewith according to another embodiment of the invention.

FIG. 6 shows another embodiment of the invention. The vent window cores 50 are assembled with the IBCC 14 instead of the crankcase chill 28*a* shown in FIGS. 4-6. Assembly of the vent window cores 50 with the IBCC 14 facilitates proper positioning of the vent window cores 50 in respect of the IBCC 14 and the cylinder barrel features 70. The assembled cores 14, 50 can be dipped in a refractory wash to reduce or eliminate a casting fin (not shown) that may otherwise form in a dividing space between an end of the shoulder 56 of the vent window core 50 and the crankcase feature 71. This minimizes the risk that a stress rise will be created at the periphery of the window 44 as an unintended result during a machining process used to remove the casting fin.

The resin-bonded sand cores can be made using conventional core-making processes such as a phenolic urethane cold box or Furan hot box where a mixture of foundry sand and resin binder is blown into a core box and the binder cured with either a catalyst gas and/or heat. The foundry sand can comprise silica, zircon, fused silica, and others.

The cores 14, 16, 18, 22, 24 are typically initially assembled apart from the base core 12 and cover core 26 to form a subassembly or core package 30 of multiple cores. The cores 14, 16, 18, 22, 24 are assembled on a temporary base TB that does not form a part of the final engine block mold package 10.

The subassembly 30 and the temporary base TB are separated by lifting the subassembly 30 off of the temporary base TB at a separate station. The temporary base TB is returned to the starting location of the subassembly sequence where a new integral barrel crankcase core 14 is placed thereon for use in assembly of another subassembly 30.

The subassembly 30 is taken to a cleaning station or blow-off station BS, where the subassembly 30 is cleaned to remove loose sand from the exterior surfaces of the subassembly 30 and form interior spaces between the cores 12, 16, 18, 22, 24, 26 thereof. The loose sand typically is present as a result of the cores rubbing against one another at the joints therebetween during the subassembly sequence. A small amount of sand can be abraded off of the mating joint surfaces and lodge on the exterior surfaces and in narrow spaces between adjacent cores where its presence can contaminate the engine block casting made in the mold package 10.

The blow-off station BS typically includes a plurality of high velocity air nozzles N which direct high velocity air on exterior surfaces of the subassembly 30 and into the narrow spaces between adjacent cores 12, 16, 18, 22, 24, 26 to dislodge any loose sand particles and cause the sand to be blown out of the subassembly 30. In lieu of, or in addition to, moving the subassembly 30, the nozzles N may be movable relative to the subassembly 30 to direct high velocity air at the exterior surfaces of the subassembly 30 and into the narrow spaces between adjacent cores 12, 16, 18, 22, 24, 26. It is understood that other cleaning methods can be used as desired such as the use of a vacuum cleaning station, for example.

The cleaned subassembly 30 is positioned on base core 12 residing on the chill plate 28*b.* Chill plate 28*b* includes the mold stripper plate 28*c* disposed on the chill plate 28*b* to support the base core 12. The base core 12 is placed on the mold stripper plate 28*c* with the crankcase chill 28*a* disposed on the chill plate 28*b*. The crankcase chill 28*a* can be produced from an assembly or formed as a unitary structure. The crankcase chill 28*a* extends through an opening formed in mold carrier plate 28*c* and an opening formed in the base core 12 into a cavity formed in the IBCC 14. The chill plate 28*b* includes apertures through which lifting rods R extend which facilitate separating the crankcase chill 28*a* from the mold carrier plate 28*c* and mold package 10. The crankcase chill 28*a* can be made of cast iron or other suitable thermally conductive material to rapidly remove heat from the bulkhead features of the casting, the bulkhead features being those casting features that support the engine crankshaft via the main bearings and main bearing caps. The chill plate 28*b* and the mold carrier plate 28*c* can be constructed of steel, thermal insulating ceramic plate material, combinations thereof, or other durable material. The function of the chill plate 28*b* is to facilitate the handling of the crankcase chill 28*a* and other chills, and the function of the mold carrier plate 28*c* is to facilitate the handling of the mold package 10. The chill plate 28*b* and the mold carrier plate 28*c* typically are not intended to play a significant role in extraction of heat from the casting, however.

The cover core 26 is placed on the base core 12 and subassembly 30 to complete assembly of the engine block mold package 10. Additional cores (not shown) which are not part of the subassembly 30 can be placed on or fastened to the base core 12 and the cover core 26 as desired before being moved to the assembly location where the base core 12 and the cover core 26 are united with the subassembly 30. For example, the subassembly 30 can be assembled without side cores 16, which instead are assembled on the base core 12. The subassembly 30 without side cores 16 is subsequently placed in the base core 12 having side cores 16 thereon.

The completed engine block mold package 10 is moved to a mold filling station MF, where the mold package 10 is filled with molten metal such as molten aluminum, for example. Any suitable mold filling technique may be used to fill the mold package 10 such as gravity pouring or electromagnetic pump, for example.

After a predetermined time following casting of the molten metal into the mold package 10, the mold package 10 is moved to a station where the lift rods R are inserted through the holes of chill plate 28*b* to raise and separate the mold carrier plate 28*c* with the cast mold package 10 thereon from the chill plate 28*b*. The chill plate 28*b* can be returned to the beginning of the assembly process for reuse in assembling another mold package 10. The cast mold package 10 can be further cooled on the mold carrier plate 28*c*, and a cast cylinder block removed.

Figure 7:
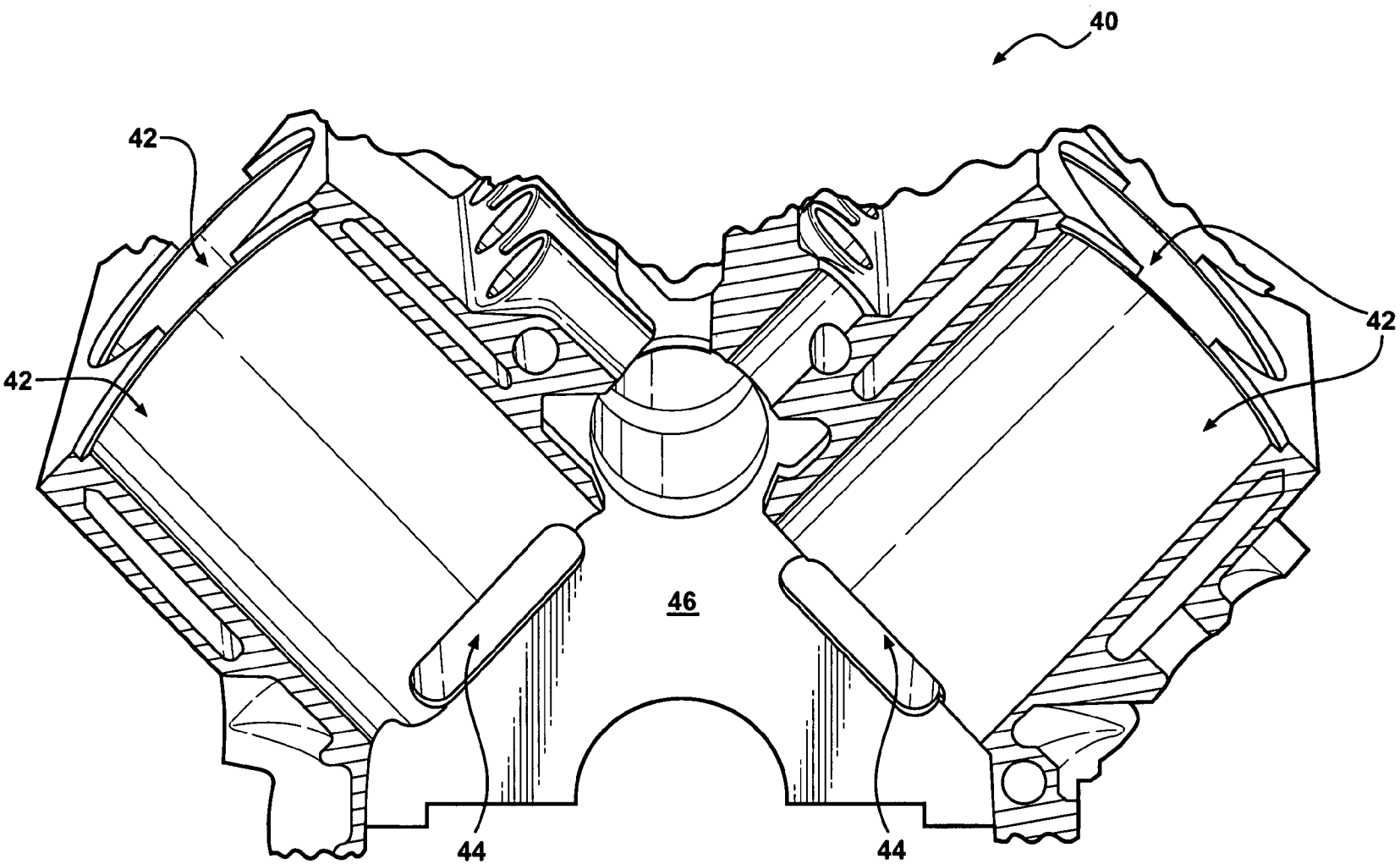
FIG. 7 is a perspective view partially in section of an engine V-block produced using the V-block mold package of FIG. 1 and showing a vent window formed according to an embodiment of the invention.

FIG. 7 illustrates a V-type engine cylinder block 40 produced from the mold package of FIG. 1. An end of the engine cylinder block 40 is shown in section to reveal cylinder bores 42. Two rows of cylinder bores 42 are provided in the V-type engine cylinder block 40. A bulkhead window 44 is formed in the bulkhead 46 between adjacent cylinder bores 42 in each row. During casting of the engine cylinder block 40, the vent window cores 50 cause the bulkhead window 44 to be formed between the bays formed in the engine cylinder block 40 below each pair of opposed cylinder bores 42. In the embodiment shown, the bulkhead windows 44 are disposed at an angle of about 45 degrees with horizontal and facilitate fluid communication between bays formed in the engine cylinder block 40 below each cylinder bore 42.

The bulkhead 46 is typically the highest stressed portion of the engine cylinder block 40. Therefore, proper design of the position, size, and orientation of the bulkhead window 44 can help to minimize the maximum stress level created in the bulkhead 46. For example, if parting lines are positioned at or in the wall forming the bulkhead window 44 resulting in parting fins, overstressing can result. Additionally, if the position of the bulkhead window 44 is moved or skewed from the desired position, overstressing of the bulkhead 46 can result.

The present invention militates against overstressed conditions in the bulkhead 46. Since the vent window cores 50 are assembled with one of the crankcase chill 28*a* and the IBCC 14, the position of the vent window cores 50, and thus the bulkhead window 44, can be accurately controlled. Additionally, the shoulder 56 of the vent window core 50 avoids positioning of a parting line in the bulkhead window 44. The size and orientation of the bulkhead window 44 is also accurately controlled. Production costs are minimized since further machining of the bulkhead 46 around the bulkhead window 44 is minimized due to the absence of parting fins, core seams, and the like. Finally, if changes in geometry, size, location, and the like become necessary, the vent window core 50 can be easily and conveniently changed.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A vent window core comprising:

a main body adapted to be assembled with one of a crankcase chill and an integral barrel crankcase core of a mold package, said main body having a substantially planar lower surface;

a shoulder extending laterally outwardly from a side of said main body and at an angle with respect to the lower surface of the main body, a cross-sectional shape of said shoulder determining a final shape of a vent window formed in a bulkhead of an engine cylinder block, and wherein said shoulder has a length which is substantially equal to a desired depth of the window; and a recess formed in an outer surface of said main body adjacent said shoulder, said recess formed by a semicircular upper wall and a substantially planar side wall and adapted to receive an extension of the crankcase chill therein when assembled in the mold package.

2. The vent window core according to claim 1, wherein said shoulder is disposed at an angle of 45 degrees with respect to the lower surface.

3. The vent window core according to claim 1, including a transition section disposed between said main body and said shoulder.

4. The vent window core according to claim 3, wherein an outer surface of said transition section is rounded.

5. The vent window core according to claim 1, wherein said shoulder has an elongated substantially oval cross-sectional shape.

6. A mold package for casting of an engine cylinder block comprising:

a crankcase chill;

an integral barrel crankcase core adapted to be disposed on said crankcase chill; and a vent window core adapted to be disposed between said crankcase chill and said integral barrel crankcase core, said vent window core further comprising:

a main body having a substantially planar lower surface;

a shoulder extending laterally outwardly from a side of said main body and at an angle with respect to the lower surface of the main body, a cross-sectional shape of said shoulder determining a final shape of a window formed in a bulkhead of an engine cylinder block; and a recess formed in an outer surface of said main body adjacent said shoulder, said recess formed by a semicircular upper wall and a substantially planar side wall and adapted to receive an extension of the crankcase chill therein.

7. The mold package according to claim 6, wherein said shoulder is disposed at an angle of 45 degrees with respect to the lower surface.

8. The mold package according to claim 6, including a transition section disposed between said main body and said shoulder.

9. The mold package according to claim 8, wherein said transition section has a rounded outer surface.

10. The vent window core according to claim 6, wherein said shoulder has an elongated substantially oval cross-sectional shape.

11. A method of producing a cylinder block casting, the method comprising the steps of:

providing a mold package;

providing a vent window core including a main body having a substantially planar lower surface, a shoulder extending laterally outwardly from a side of the main body and at an angle with respect to the lower surface of the main body, a shape of the shoulder determining a final shape of a window formed in a bulkhead of the engine cylinder block, and a recess formed in an outer surface of said main body adjacent said shoulder, said recess formed by a semicircular upper wall and a substantially planar side wall;

assembling the vent window core with the mold package;

filling the mold package with molten metal; and removing the cylinder block casting from the mold package.

12. The method according to claim 11, further comprising the step of assembling the vent window core in a crankcase chill prior to assembly with the mold package.

13. The method according to claim 11, further comprising the step of assembling the vent window core in an integral barrel crankcase core prior to assembly with the mold package.

* * * * *